United States Patent [19]

Bauer

[11] Patent Number: 4,788,734

[45] Date of Patent: Dec. 6, 1988

[54] TOOTHBRUSH HAVING SIGNAL PRODUCING MEANS

[76] Inventor: Gerfried Bauer, Säntisstrasse 21, 8805 Richterswil, Switzerland

[21] Appl. No.: 850,562

[22] Filed: Apr. 11, 1986

[30] Foreign Application Priority Data

Apr. 20, 1985 [CH] Switzerland ..... 01686/85

[51] Int. Cl.[4] ..... A46B 9/04

[52] U.S. Cl. ..... 15/105; 15/167.1; 84/94.2; 434/263

[58] Field of Search ..... 15/167 R, 167 A, 105; 434/263; 446/76, 81; 84/1.01, 94 R, 95 R; 128/359, 360

[56] References Cited

U.S. PATENT DOCUMENTS

| | | | |
|---|---|---|---|
| 1,792,358 | 2/1931 | Byers et al. | 15/22 A |
| 4,253,212 | 3/1981 | Fujita | 15/167 R |
| 4,525,878 | 7/1985 | Lowe, Jr. | 84/94 C |
| 4,554,919 | 11/1985 | Hubert | 128/360 |
| 4,607,747 | 8/1986 | Steiner | 84/94 C |
| 4,615,681 | 10/1986 | Schwarz | 434/236 |

FOREIGN PATENT DOCUMENTS

| | | | |
|---|---|---|---|
| 0028678 | 5/1981 | European Pat. Off. . | |
| 7342778 | 11/1973 | Fed. Rep. of Germany . | |
| 3149233 | 4/1983 | Fed. Rep. of Germany | 15/105 |
| 3309687 | 9/1984 | Fed. Rep. of Germany . | |
| 2471757 | 6/1981 | France . | |
| 2097663 | 11/1982 | United Kingdom . | |

*Primary Examiner*—Peter Feldman

*Attorney, Agent, or Firm*—Burns, Doane, Swecker & Mathis

[57] ABSTRACT

The handle part (2) of a toothbrush houses means which emit acoustic signals in the audible range of the human ear. The means are a chip (3), a battery (4), a sound generator (5), a sound amplifier (6) and a switch (7). By incorporating other similar means, the emission of visual signals is produced. The means (3, 4, 5, 6, 7), which are combined to form a module, are suitable for emitting a melody and/or spoken words. The chip (3) is supplemented with a "timer", the cycle of which is set, or can be set, and preferably lasts for two minutes per actuation. The battery (4) has a life of three months when used twice a day for two minutes in each case.

3 Claims, 1 Drawing Sheet

TOOTHBRUSH HAVING SIGNAL PRODUCING MEANS

FIELD OF THE INVENTION

The present invention relates to a toothbrush which includes a signal generating means.

BACKGROUND OF THE INVENTION

The most widespread tooth diseases are caries and parodontitis. Parodontitis is understood as being the gradual destruction of tooth-holding apparatus. Both diseases are caused by bacteria which collect in particular between the teeth and which form acids and poisons during the long chain of their destruction. It is this which forms the basis of the prophylaxis against these diseases, which is available to and readily applicable by anyone.

Healthy nutrition specifically with regard to the teeth is surely among the initial prophylactic measures. By reducing the intake of sugar, the growth of bacteria, and hence also the formation of acids and poisons, can be minimized. However, completely dispensing with the consumption of sugar is hardly possible in daily life. If this fact is taken into account, oral hygiene is accordingly the most important factor in combatting caries and parodontitis. Regular removal of food residues prevents a sharp increase in bacteria and consequently prevents, on the one hand, the formation of acids and, on the other hand, irritation of the gums by dead bacteria, which gives rise to the risk of parodontitis. Brushing the teeth for at least two minutes after each main meal is regarded as optimum.

It is precisely this simple porphylaxis which appears to present the greatest problems in daily life, not only in the case of children, whose dislike of cleaning teeth is well known, but also in the case of adults, who state that they have great difficulty in maintaining a minimum time for brushing their teeth.

Various attempts have been made to help maintain this time by providing acoustic and/or visual aids. Market observation and questionnaires show that the attempts made so far have not yet provided an attractive solution.

OBJECTS AND SUMMARY OF THE INVENTION

The invention intends to remedy this.

One object of the invention, as characterized in the claims, to propose a toothbrush which, when used, makes it substantially easier to maintain the minimum time for brushing the teeth, which is recommended as a prophylaxis against caries and parodontitis. This is achieved by objectifying the time on the one hand and on the other hand by making this particular period of time pleasant to the senses.

The essential advantages of the invention are that the desired objective can be achieved without the aid of external auxiliaries. By actuating a capacitive of inductive switch which is located in the handle of the toothbrush and, in a preferred embodiment of the invention, is positioned at thumb height in a conventional toothbrush handle, the means housed there and preferably combined to form a single module are activated so that a melody and/or spoken words of any type are emitted. The emission time corresponds to the time span which is regarded by dental science as being the optimum time for which the teeth should be brushed after each main meal, namely two minutes in each case.

This provides a sensitive pleasant component which, particularly in the case of children, acts as an encouragement and stimulus to clean the teeth regularly and to continue this process for as long as the acoustic signals last.

In the case of adults, the objectification of time which this provides and which is signalled by completion of the emission is certainly of prime importance. Meanwhile, it should also be mentioned that the sound of, for example, a melody which is a personal favorite will certainly also stimulate those who are no longer children to maintain the duration and repetitive nature of the process.

In another preferred embodiment of the invention, it is possible to generate visual signals, which may be particularly advantageous for the hard of hearing.

Another advantage of the invention is that the time when, for hygienic reasons, the toothbrush should be changed is unmistakably indicated by the absence of the emission, this time being related not so much to the wearing out of the bristles but primarily to the danger of transferring bacteria which multiply on the bristle part. When used twice a day for two minutes in each case, the battery has in fact a lift of three months, that is to say the lift after which dental science expects a toothbrush to be replaced.

The means are commercial elements, so that from the economic point of view the toohbrush is certainly disposable.

Another advantage of the invention is that the toothbrushes can be programmed with various melodies and/or spoken words, such as, for example, instructions, communications, conversation, etc. Hence, the acquisition of a new toothbrush affords the possibility of deciding in favour of a new melody or type of emission.

Furthermore, the toothbrush can readily be designed so that the bristle part is replaceable. In an embodiment of this type, it is advantageous for the snap-on and disposable bristle part to contain the battery. Moreover, the bristle part may be electrically operated, with the result that brushing of the teeth is facilitated and intensified.

BRIEF DESCRIPTION OF THE DRAWING

In the drawing, illustrative examples of the invention are shown schematically and described in detail. All elements which are not essential for directly understanding the invention have been omitted.

Figure 1:
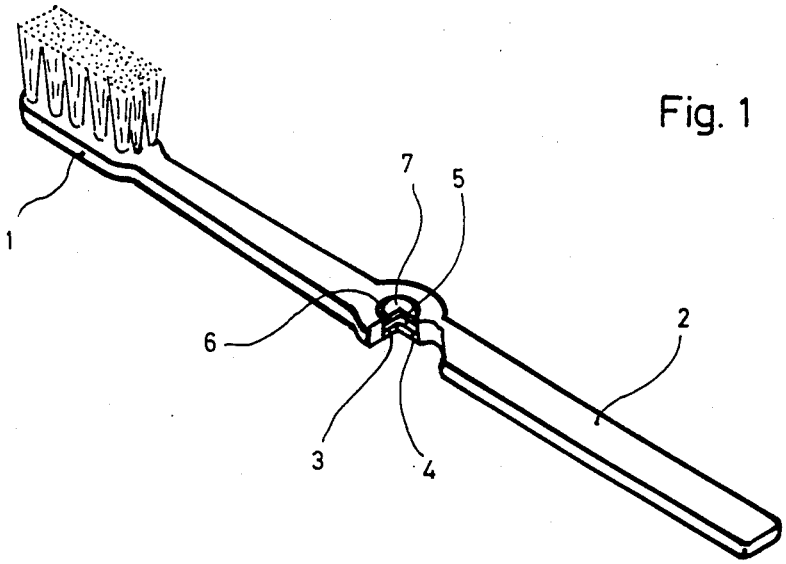
FIG. 1 is a perspective view of a toothbrush in which the means for emitting acoustic signals have been integrated to form a single module.

The toothbrush which is shown in FIG. 1 and which essentially consists of bristle part 1 and handle part 2 is supplemented by means which emit acoustic signals in the audible range of the human ear.

The emission may be a melody or spoken words, such as, for example, accompanying instructions on cleaning teeth, a short language course, etc. The emitting means of the example illustrated here are chip 3, battery 4, sound generator 5, sound amplifier 6 and switch 7. When the capacitive or inductive switch 7 is actuated, the chip 3 is fed by the battery 4. The chip 3, which is programmed for a particular emission, transmits its signals to the sound generator 5. If this is a piezoelectric sound generator, it accepts a current of 0.1 mA at 1.5 V. The pulses from the chip 3 are converted in sound generator 5 into signals which have a sequence which produces a melody or spoken words. In order to improve the sound quality and sound level, the sound generator 5 is connected to a sound amplifier 6. The handle part 2 of the toothbrush can simultaneously serve as the sound amplifier. This is set at a medium sound level. Of course, it can readily be extended to form an adjustable element, which is particularly appropriate when the bristle part 1 is electrically operated. In such a case, the adjustment could be made by means of, for example, a switch 7, which in this case is rotatable. The chip 3 incorporates a "timer", which is preferably set at a pulse duration of two minutes. In this case too, it is of course possible to provide for an individually adjustable pulse duration. When the toothbrush is used twice a day for two minutes in each case, the battery 4 has a life of three months. This life corresponds to the duration for using a toothbrush, as recommended by dental science. Consequently, the time when the toothbrush should be changed is indicated unmistakably. This constitutes an additional prophylaxis for preventing tooth diseases, which may be initiated by the bacteria which multiply on the bristle part 1 in the course of time. The means 3, 4, 5, 6 and 7 are commercially available elements. It is possible to combine these into a single module in the form of a disc which, on the basis of the present day state-of-the-art, has overall dimensions corresponding to a diameter of about 15 mm and a thickness of about 2–4 mm. Hence, a disc of this type can easily be housed in, or mounted on, the handle part 2, either during production of the toothbrush or thereafter. The switch 7 is positioned at thumb height on a conventional toothbrush handle; this makes it possible to switch on in practice as soon as the toothbrush is gripped. The bristle part 1 can be designed in such a way that it is replaceable. This will be appropriate whenever it is part of an electrically operated tooth brush. It is also obvious that, in a toothbrush which is not electrically operated, the bristle part 1 should contain the battery 4, thus optimizing the disposability of the two parts which are consumed.

Figure 2:
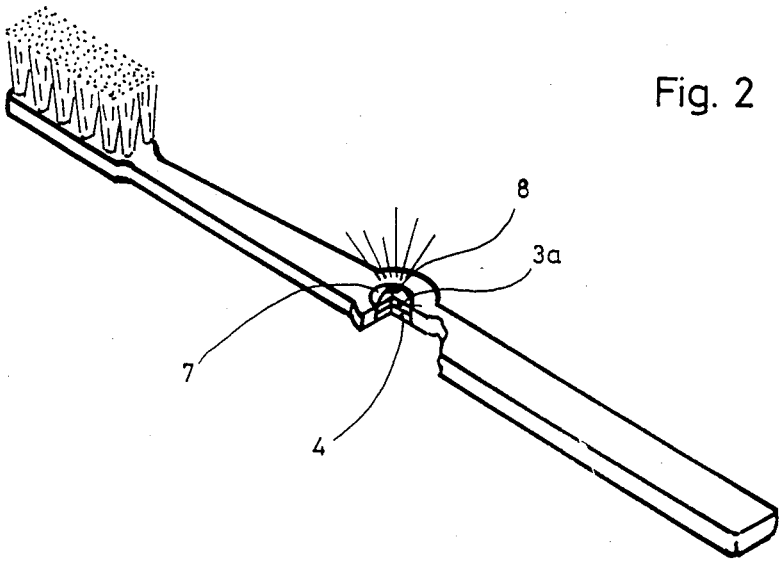
FIG. 2 is a perspective view of a similar toothbrush as that shown in FIG. 1, the signal emitting means in this case emitting visual signals.

FIG. 2 shows a toothbrush similar to that shown in FIG. 1. The difference is that this toothbrush is designed to produce visual signals. The means in this case are a battery 4, a clock 3*a*, a switch 7, and a light source 8 integrated in the switch 7. The mode of operation and the advantages are the same as those described for FIG. 1. When the switch 7 is actuated, the light source 8 is illuminated and emits light for the set or settable time interval.

What is claimed is:

1. A tooth brushing apparatus comprising:

a bristle part, a handle, signal producing means in said handle for producing acoustic signals within the audible range of the human ear, said signal producing means being held in a structural module and including a circuit formed by an integrated circuit chip, a battery, and a switch, said battery being replaceable and having a life of approximately three months when said tooth brushing apparatus is employed for a predetermined length of time twice a day so as to signal the end of the recommended life of said bristle part, said predetermined length of time being substantially two minutes to coincide with the optimum time for which teeth should be brushed, said chip being programmed to emit pulses when the circuit is closed and having timing means for keeping said circuit closed for said predetermined length of time after activation of the switch, said length of time being based upon an optimum time for which teeth should be brushed upon actuation of said switch, a sound generator connected with said chip and formed of a piezoelectric resonator which converts the electrical pulses delivered from said chip into acoustic energy, and a sound amplifier for amplifying said acoustic energy outside of said apparatus.

2. A tooth brushing apparatus according to claim 1 wherein said bristle part forms a portion of said handle.

3. A tooth brushing apparatus according to claim 1, wherein the handle serves as the sound amplifier.

* * * * *